US011607067B2

(12) United States Patent
Horn

(10) Patent No.: US 11,607,067 B2
(45) Date of Patent: Mar. 21, 2023

(54) DELIVERY RECEIVING ASSEMBLY

(71) Applicant: Tema Horn, Toledo, OH (US)

(72) Inventor: Tema Horn, Toledo, OH (US)

( * ) Notice: Subject to any disclaimer, the term of this patent is extended or adjusted under 35 U.S.C. 154(b) by 420 days.

(21) Appl. No.: 16/936,009

(22) Filed: Jul. 22, 2020

(65) Prior Publication Data

US 2022/0022678 A1 Jan. 27, 2022

(51) Int. Cl.

| | |
|---|---|
| ***A47G 29/14*** | (2006.01) |
| ***A47G 29/30*** | (2006.01) |
| ***A47G 29/20*** | (2006.01) |

(52) U.S. Cl.

CPC ..... *A47G 29/141* (2013.01); *A47G 29/20* (2013.01); *A47G 29/30* (2013.01); *A47G 2029/143* (2013.01)

(58) Field of Classification Search

None

See application file for complete search history.

(56) References Cited

U.S. PATENT DOCUMENTS

| | | | |
|---|---|---|---|
| D445,234 S | 7/2001 | Isaacs | |
| 6,690,997 B2 | 2/2004 | Rivalto | |
| 2016/0066733 A1 | 3/2016 | Gozar | |
| 2017/0124510 A1 | 5/2017 | Caterino | |
| 2017/0255896 A1 | 9/2017 | Van Dyke | |
| 2018/0005183 A1 | 1/2018 | Nguyen | |
| 2021/0022536 A1* | 1/2021 | Anderson | G06Q 10/0832 |

FOREIGN PATENT DOCUMENTS

| | | |
|---|---|---|
| WO | WO2017058924 | 4/2017 |

* cited by examiner

*Primary Examiner* — K. Wong

(57) ABSTRACT

A delivery receiving assembly for enabling secure unattended delivery of an item includes a housing, which has an opening positioned therein. A door is hingedly engaged to the housing and is positioned to cover the opening. A locking unit, which is engaged to one of the housing and the door and is selectively engageable to the other of the housing and the door, is positioned to secure the door over the opening. A keypad is engaged to one of the housing and the door. A microprocessor is engaged to the housing and is operationally engaged to the keypad and the locking unit. Upon entry of a code into the keypad, the microprocessor actuates the locking unit to unlock the door. An alarm is engaged to the housing and is operationally engaged to the microprocessor. The microprocessor selectively actuates the alarm upon entry of an incorrect code into the keypad.

20 Claims, 5 Drawing Sheets

DELIVERY RECEIVING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to receiving assemblies and more particularly pertains to a new receiving assembly for enabling secure unattended delivery of an item.

(2) Description of Related Art Including Information Disclosed Under 37 CFR 1.97 and 1.98

The prior art relates to receiving assembly. Prior art delivery receiving assemblies may comprise housings having one opening for inserting a package and another opening for retrieving the package, magnetic locks, remote access code generators, parcel scanning devices, and authentication devices.

BRIEF SUMMARY OF THE INVENTION

An embodiment of the disclosure meets the needs presented above by generally comprising a housing, which defines an internal space and which has an opening positioned therein. A door is hingedly engaged to the housing and is positioned to cover the opening.

A locking unit, which is engaged to one of the housing and the door and is selectively engageable to the other of the housing and the door, is positioned to secure the door over the opening. A keypad is engaged to one of the housing and the door. A microprocessor is engaged to the housing and is operationally engaged to the keypad and the locking unit. The keypad is configured for entry of a code, positioning the microprocessor to actuate the locking unit to unlock the door.

An alarm is engaged to the housing and is operationally engaged to the microprocessor, positioning the microprocessor to selectively actuate the alarm upon entry of an incorrect code into the keypad.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
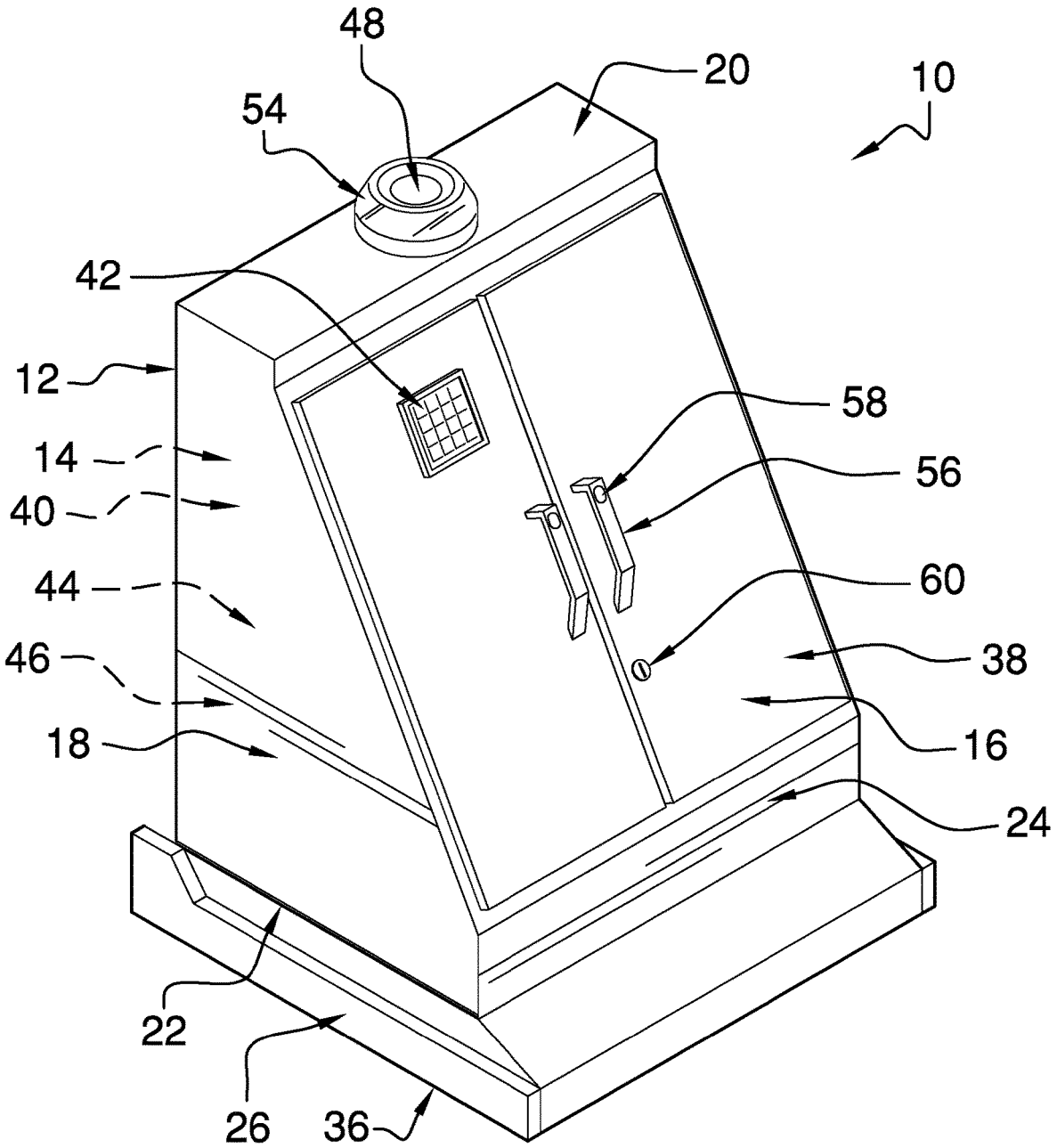
FIG. 1 is an isometric perspective view of a delivery receiving assembly according to an embodiment of the disclosure.

With reference now to the drawings, and in particular to FIGS. 1 through 5 thereof, a new receiving assembly embodying the principles and concepts of an embodiment of the disclosure and generally designated by the reference numeral 10 will be described.

As best illustrated in FIGS. 1 through 5, the delivery receiving assembly 10 generally comprises a housing 12, which defines an internal space 14 and which has an opening 16 positioned therein. The housing 12 has opposed sides 18, which are tapered so that a top 20 of the housing 12 is circumferentially smaller than a bottom 22 of the housing 12. The opening 16 is positioned in a front 24 of the housing 12 and extends from the top 20 to proximate to the bottom 22 and between the opposed sides 18.

A base 26 is engaged to the housing 12 and is configured to stabilize the housing 12 on a substantially horizontal surface. The base 26 is weighted so that the base 26 is configured to deter movement the housing 12.

Figure 2:
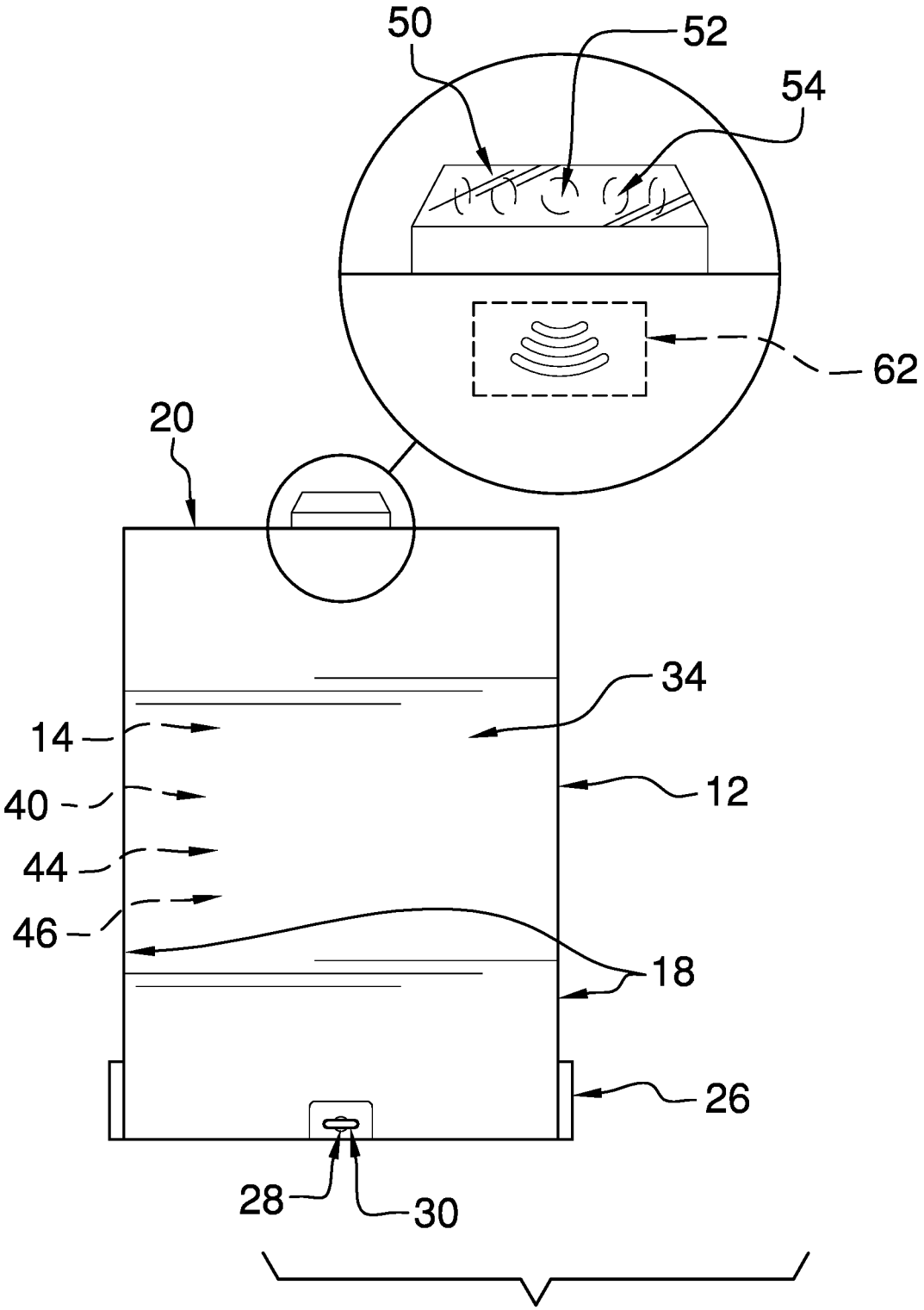
FIG. 2 is a rear view of an embodiment of the disclosure.

A fastener 28 is engaged to one of the base 26 and the housing 12. The fastener 28 is configured to engage a stationary element, such as a wall of a structure, to deter theft of the housing 12 and contents thereof. The fastener 28 may comprise an eyelet 30, which is engaged to one of the base 26 and the housing 12. As shown in FIG. 2, the eyelet 30 is engaged to the base 26. A cable 32 is configured to engage the eyelet 30 and the stationary element. The cable 32 is configured to tether the housing 12 to the stationary element.

The present invention anticipates the fastener 28 comprising other fastening means, such as holes (not shown) in a back 34 of the housing 12 or a lower end 36 of the base 26. The holes are configured for insertion of mounting hardware (not shown) to engage the housing 12 to a substantially vertical stationary element or the base 26 to the substantially horizontal surface, respectively.

Figure 3:
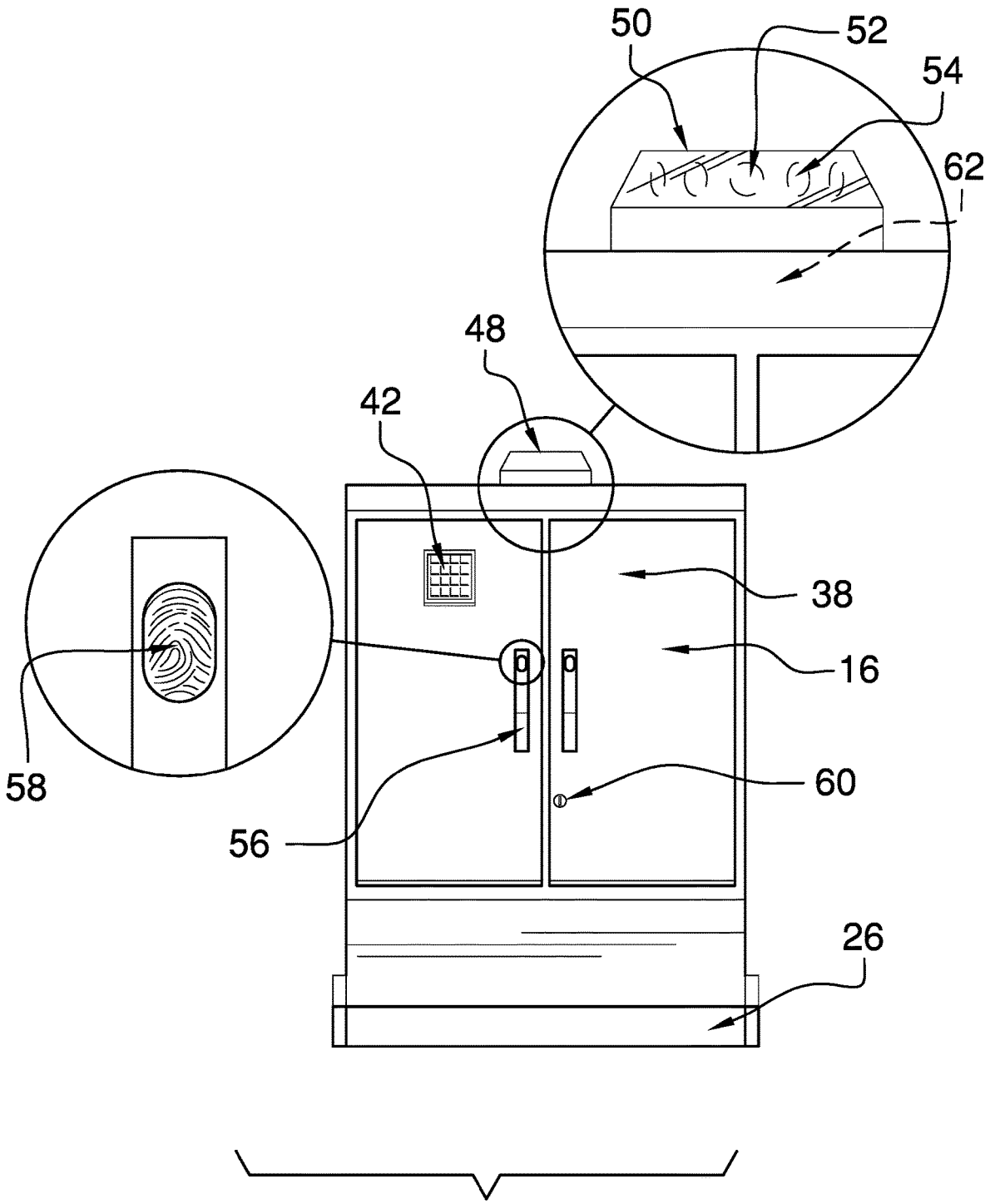
FIG. 3 is a front view of an embodiment of the disclosure.
Figure 4:
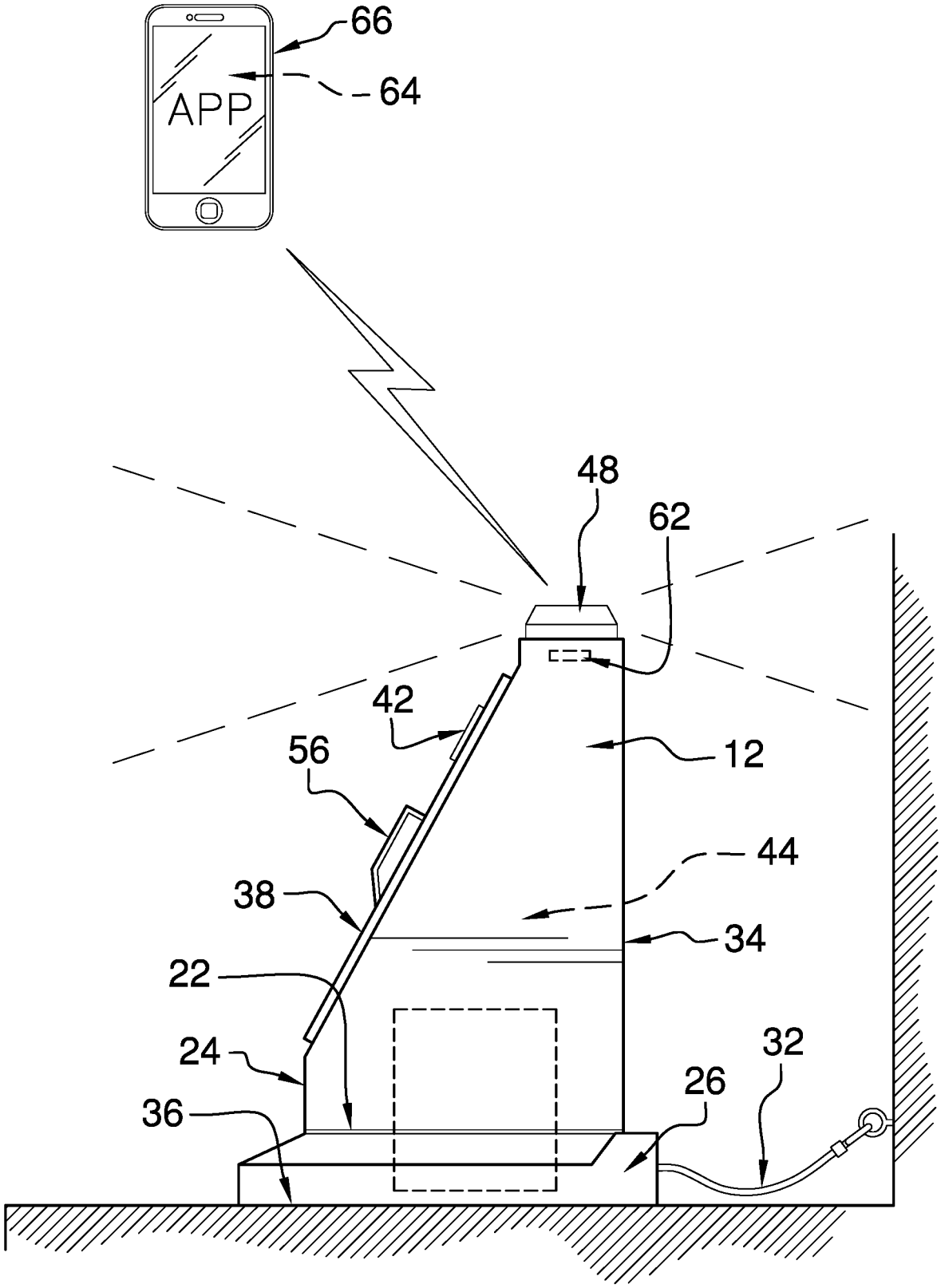
FIG. 4 is a side view of an embodiment of the disclosure.

A door 38 is hingedly engaged to the housing 12 and is positioned to cover the opening 16. The door 38 and the housing 12 comprise metal. The door 38 may be one of a pair of doors 38, as shown in FIG. 3, with each door 38 being hingedly engaged to a respective opposed side 18 of the housing 12. The door 38 may be configured to be self-opening. As will become apparent, the door 38 being self-opening would enable unmanned delivery of an item, such as an item delivered by a drone.

A locking unit 40, which is engaged to one of the housing 12 and the door 38 and is selectively engageable to the other of the housing 12 and the door 38, is positioned to secure the door 38 over the opening 16. With the door 38 being one of a pair of doors 38, the locking unit 40 is engaged to one of the doors 38 of the pair of doors 38 and is selectively engageable to the other of the doors 38 of the pair of doors 38.

A keypad 42 is engaged to one of the housing 12 and the door 38. As shown in FIG. 3, the keypad 42 is engaged to the door 38. A microprocessor 44 is engaged to the housing 12 and is operationally engaged to the keypad 42 and the locking unit 40. A power module 46 is engaged to the housing 12 and is operationally engaged to the microprocessor 44. The present invention anticipates the assembly 10 being one or both of battery powered and engageable to an electrical circuit. The keypad 42 is configured for entry of a code, positioning the microprocessor 44 to actuate the locking unit 40 to unlock the door 38.

An alarm 48 is engaged to the housing 12 and is operationally engaged to the microprocessor 44, positioning the microprocessor 44 to selectively actuate the alarm 48 upon entry of an incorrect code into the keypad 42. The alarm 48 comprises one or both of a siren 50 and a bulb 52. The siren 50 is configured to emit an audible alarm 48 and the bulb 52 is configured to emit a visual alarm 48.

A camera 54 is engaged to the housing 12 and is operationally engaged to the microprocessor 44. The camera 54 is configured to capture an image of an area proximate to the housing 12 and to relay the image to the microprocessor 44. The camera 54 may have a 360 degree field of view, or other field of view, such as 180 degrees, which would be suitable for a housing 12 positioned next to a wall. The camera 54 may be configured to capture an audiovisual image and may be motion activated.

A handle 56 is engaged to the door 38. The handle 56 is configured to be grasped in a hand of a user so that the user is positioned to hinge the door 38 relative to the housing 12. The handle 56 may be one of a pair of handles 56 engaged singly to each door 38 of a pair of doors 38.

A fingerprint scanner 58 is engaged one of the housing 12 and the door 38 and is operationally engaged to the microprocessor 44. The fingerprint scanner 58 is configured to scan a fingerprint, positioning the microprocessor 44 to authenticate the fingerprint and to selectively actuate the locking unit 40 to unlock the door 38. As shown in FIG. 3, the fingerprint scanner 58 may be engaged to the handle 56. The fingerprint scanner 58 also may be one of a pair of fingerprint scanners 58 engaged singly to a pair of handles 56. The fingerprint scanner 58 provides an alternative method of actuating the locking unit 40.

A lock 60 is engaged to the door 38 and is operationally engaged to the locking unit 40. The lock 60 is configured for insertion of a corresponding key (not shown). The user is positioned to turn the corresponding key to actuate the locking unit 40 to unlock the door 38. The lock 60 provides an alternative method of actuating the locking unit 40.

A transceiver 62 is engaged to the housing 12 and is positioned in the internal space 14. The transceiver 62 is operationally engaged to the microprocessor 44 and is configured to transmit and to receive wireless signals, such as signals for local area networking, cellular communications, and the like.

Programming code 64 is positioned on an electronic device 66 of the user, enabling the user to instruct the microprocessor 44 to implement at least one of a security protocol and a delivery protocol, which should be interpreted to mean only one or more security protocols, only one or more delivery protocols, or a combination thereof.

For example, a security protocol may instruct the microprocessor 44 to actuate the camera 54 when motion is detected within a defined area around the housing 12. The security protocol also may have an instruction for actuating the alarm 48, such as when a defined number of incorrect entries have been attempted on the keypad 42, an unauthorized key is inserted into the lock 60, or if the door 38 is left in an open position for a defined period of time. The security protocol also may have an instruction for actuating the locking unit 40 upon closure of the door 38.

Figure 5:
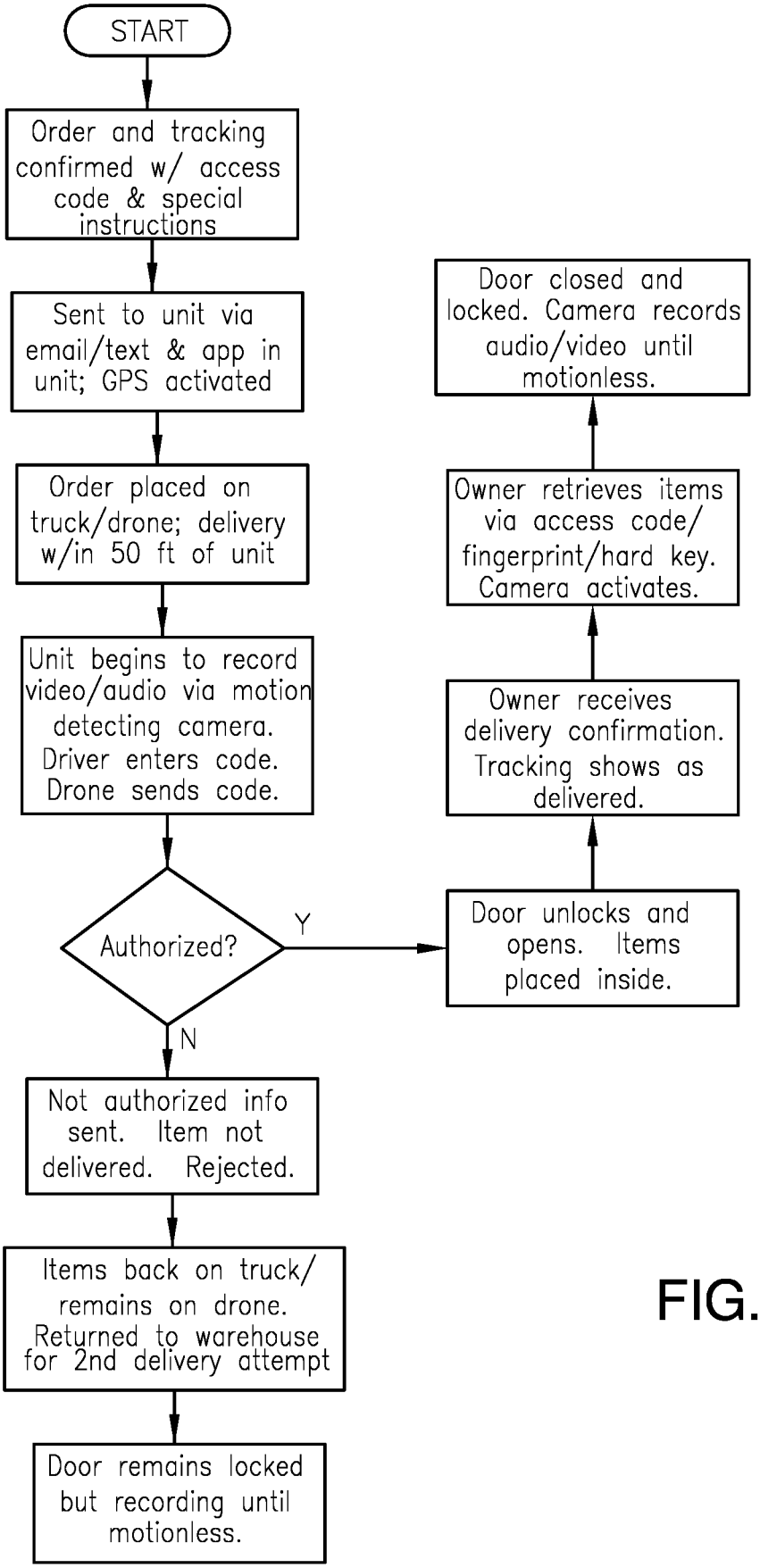
FIG. 5 is a flow diagram of an embodiment of the disclosure.

The delivery protocol may comprise an instruction for receipt of tracking information via the transceiver 62, an instruction for sending a code for the keypad 42, an instruction for unlocking of the door 38 when a delivery item is proximate to the housing 12, and an instruction for providing notice to the user of delivery. A flow diagram showing an example combination of a security protocol and a delivery protocol is shown in FIG. 5.

In one example of use, a delivery agent is sent a code for the keypad 42. As the delivery agent approaches the housing 12 the camera 54 is actuated to capture the image. When the code is entered, the locking unit 40 is actuated to unlock the door 38, allowing the deliver agent to position the item in the housing 12. Notice of the delivery is sent to the user via the transceiver 62. The user is positioned to retrieve the item by unlocking the door 38 via entry of a code into the keypad 42, placing of a finger upon the fingerprint scanner 58, or insertion of the corresponding key into the lock 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A delivery receiving assembly comprising:

a housing defining an internal space, the housing having an opening positioned therein;

a door hingedly engaged to the housing and being positioned for covering the opening;

a locking unit engaged to one of the housing and the door and being selectively engageable to the other of the housing and the door, such that the locking unit is positioned for securing the door over the opening;

a keypad engaged to one of the housing and the door;

a microprocessor engaged to the housing and positioned in the internal space, the microprocessor being operationally engaged to the keypad and the locking unit, wherein the keypad is configured for entering of a code, positioning the microprocessor for actuating the locking unit for unlocking the door; and an alarm engaged to the housing and being operationally engaged to the microprocessor, positioning the microprocessor for selectively actuating the alarm upon entry of an incorrect code into the keypad.

2. The delivery receiving assembly of claim 1, wherein:

the housing has opposed sides, the opposed sides being tapered such that a top of the housing is circumferentially smaller than a bottom of the housing; and the opening being positioned in a front of the housing, the opening extending from the top to proximate to the bottom and between the opposed sides.

3. The delivery receiving assembly of claim 1, further including a base engaged to the housing and being configured for stabilizing the housing on a substantially horizontal surface, the base is weighted wherein the base is configured for deterring movement the housing.

4. The delivery receiving assembly of claim 3, further including a fastener engaged to one of the base and the housing, the fastener being configured for engaging a stationary element for deterring theft of the housing and contents thereof.

5. The delivery receiving assembly of claim 4, further including:

the fastener comprising an eyelet engaged to one of the base and the housing; and a cable configured for engaging the eyelet and the stationary element, wherein the cable is configured for tethering the housing to the stationary element.

6. The delivery receiving assembly of claim 1, wherein the door and the housing comprise metal.

7. The delivery receiving assembly of claim 1, wherein:

the door is one of a pair of doors, each door being hingedly engaged to a respective opposed side of the housing; and the locking unit is engaged to one of the doors of the pair of doors and is selectively engageable to the other of the doors of the pair of doors.

8. The delivery receiving assembly of claim 1, wherein the door is configured such that the door is self-opening.

9. The delivery receiving assembly of claim 1, wherein the alarm comprises one or both of a siren and a bulb, wherein the siren is configured for emitting an audible alarm and the bulb is configured for emitting a visual alarm.

10. The delivery receiving assembly of claim 1, further including a camera engaged to the housing and operationally engaged to the microprocessor, the camera being configured for capturing an image of an area proximate to the housing and for relaying the image to the microprocessor.

11. The delivery receiving assembly of claim 10, wherein the camera has a 360 degree field of view.

12. The delivery receiving assembly of claim 10, wherein the camera is configured for capturing an audiovisual image.

13. The delivery receiving assembly of claim 10, wherein the camera is motion activated.

14. The delivery receiving assembly of claim 1, a power module engaged to the housing and being operationally engaged to the microprocessor.

15. The delivery receiving assembly of claim 1, further including a handle engaged to the door, wherein the handle is configured for grasping in a hand of a user, positioning the user for hinging the door relative to the housing.

16. The delivery receiving assembly of claim 1, further including a fingerprint scanner engaged one of the housing and the door and being operationally engaged to the microprocessor, wherein the fingerprint scanner is configured for scanning a fingerprint, positioning the microprocessor for authenticating the fingerprint and for selectively actuating the locking unit for unlocking the door.

17. The delivery receiving assembly of claim 16, further including:

a handle engaged to the door, wherein the handle is configured for grasping in a hand of a user, positioning the user for hinging the door relative to the housing; and the fingerprint scanner being engaged to the handle.

18. The delivery receiving assembly of claim 1, further including a lock engaged to the door and being operationally engaged to the locking unit, wherein the lock is configured for insertion of a corresponding key, positioning a user for turning the corresponding key for actuating the locking unit for unlocking the door.

19. The delivery receiving assembly of claim 1, further including:

a transceiver engaged to the housing and positioned in the internal space, the transceiver being operationally engaged to the microprocessor, wherein the transceiver is configured for transmitting and for receiving wireless signals; and programming code positioned on an electronic device of a user, enabling the user for instructing the microprocessor for implementing at least one of a security protocol and a delivery protocol.

20. A delivery receiving assembly comprising:

a housing defining an internal space, the housing having an opening positioned therein, the housing having opposed sides, the opposed sides being tapered such that a top of the housing is circumferentially smaller than a bottom of the housing, the opening being positioned in a front of the housing, the opening extending from the top to proximate to the bottom and between the opposed sides;

a base engaged to the housing and being configured for stabilizing the housing on a substantially horizontal surface, the base being weighted wherein the base is configured for deterring movement the housing;

a fastener engaged to one of the base and the housing, the fastener being configured for engaging a stationary element for deterring theft of the housing and contents thereof, the fastener comprising an eyelet engaged to one of the base and the housing;

a cable configured for engaging the eyelet and the stationary element, wherein the cable is configured for tethering the housing to the stationary element;

a door hingedly engaged to the housing and being positioned for covering the opening, the door and the housing comprising metal, the door being one of a pair of doors, each door being hingedly engaged to a respective opposed side of the housing, the door being configured such that the door is self-opening;

a locking unit engaged to one of the housing and the door and being selectively engageable to the other of the housing and the door, such that the locking unit is positioned for securing the door over the opening, the locking unit being engaged to one of the doors of the pair of doors and being selectively engageable to the other of the doors of the pair of doors;

a keypad engaged to one of the housing and the door;

a microprocessor engaged to the housing and positioned in the internal space, the microprocessor being operationally engaged to the keypad and the locking unit, wherein the keypad is configured for entering of a code, positioning the microprocessor for actuating the locking unit for unlocking the door;

an alarm engaged to the housing and being operationally engaged to the microprocessor, positioning the microprocessor for selectively actuating the alarm upon entry of an incorrect code into the keypad, the alarm comprising one or both of a siren and a bulb, wherein the siren is configured for emitting an audible alarm and the bulb is configured for emitting a visual alarm;

a camera engaged to the housing and operationally engaged to the microprocessor, the camera being configured for capturing an image of an area proximate to the housing and for relaying the image to the microprocessor, the camera having a 360 degree field of view, the camera being configured for capturing an audiovisual image, the camera being motion activated;

a power module engaged to the housing and being operationally engaged to the microprocessor;

a handle engaged to the door, wherein the handle is configured for grasping in a hand of a user, positioning the user for hinging the door relative to the housing;

a fingerprint scanner engaged one of the housing and the door and being operationally engaged to the microprocessor, wherein the fingerprint scanner is configured for scanning a fingerprint, positioning the microprocessor for authenticating the fingerprint and for selectively actuating the locking unit for unlocking the door, the fingerprint scanner being engaged to the handle;

a lock engaged to the door and being operationally engaged to the locking unit, wherein the lock is configured for insertion of a corresponding key, positioning the user for turning the corresponding key for actuating the locking unit for unlocking the door;

a transceiver engaged to the housing and positioned in the internal space, the transceiver being operationally engaged to the microprocessor, wherein the transceiver is configured for transmitting and for receiving wireless signals; and programming code positioned on an electronic device of the user, enabling the user for instructing the microprocessor for implementing at least one of a security protocol and a delivery protocol.

* * * * *